US006058672A

United States Patent [19]

McClellan

[11] Patent Number: 6,058,672

[45] Date of Patent: May 9, 2000

[54] CONSTRUCTION OF WALL PANEL AND PANEL STRUCTURE

[76] Inventor: Robert B. McClellan, Rte. 6 Box 1174, Palatka, Fla. 32177

[21] Appl. No.: 09/089,678

[22] Filed: Jun. 3, 1998

[51] Int. Cl.[7] ..... E04B 1/38

[52] U.S. Cl. ..... 52/587.1; 52/309.12; 52/309.7; 52/309.16; 52/309.17; 52/583.1; 52/585.1; 52/592.1

[58] Field of Search ..... 52/309.12, 127.12, 52/127.7, 309.7, 309.16, 309.17, 583.1, 587.1, 585.1, 592.1

[56] References Cited

U.S. PATENT DOCUMENTS

| | | | |
|---|---|---|---|
| 2,989,155 | 6/1961 | Ocker | 52/585.1 |
| 3,369,334 | 2/1968 | Berg | 52/583.1 |
| 3,438,161 | 4/1969 | Koch | 52/309.12 |
| 4,393,635 | 7/1983 | Long | 52/309.11 |
| 4,426,061 | 1/1984 | Taggart | 249/45 |
| 4,494,353 | 1/1985 | Lewis . | |
| 4,512,126 | 4/1985 | Walston . | |
| 4,532,745 | 8/1985 | Kinard . | |
| 4,624,089 | 11/1986 | Dunker . | |
| 4,674,242 | 6/1987 | Oboler et al. | 52/91.2 |
| 4,751,803 | 6/1988 | Zimmerman . | |
| 4,841,702 | 6/1989 | Huettemann . | |
| 4,947,600 | 8/1990 | Porter . | |
| 4,974,381 | 12/1990 | Marks . | |
| 5,216,860 | 6/1993 | Thomson et al. | 52/259 |
| 5,313,753 | 5/1994 | Sanger . | |
| 5,367,847 | 11/1994 | Hepler | 52/309.4 |
| 5,488,806 | 2/1996 | Melnick et al. | 52/309.12 |
| 5,588,272 | 12/1996 | Haponski | 52/309.12 |
| 5,692,356 | 12/1997 | Baxter | 52/309.11 |
| 5,740,643 | 4/1998 | Huntley | 52/265 |
| 5,758,463 | 6/1998 | Mancini, Jr. | 52/309.12 |
| 5,839,243 | 11/1998 | Martin | 52/439 |

*Primary Examiner*—Christopher T. Kent
*Assistant Examiner*—Jennifer I. Thissell
*Attorney, Agent, or Firm*—Thomas C. Saitta

[57] ABSTRACT

A prefabricated panel and assembly of such for forming walls and roofs of buildings is formed with interior reinforcing rods, U-shaped anchor members embedded on the edges of the panel and secured members of mechanical fasteners embedded on opposing edges of adjacent panels, where the reinforcing rods embedded in the concrete body also pass through the anchors and the secured fastener members. An unsecured fastener member is connected to the secured member and tightened to join adjacent panels.

14 Claims, 8 Drawing Sheets

CONSTRUCTION OF WALL PANEL AND PANEL STRUCTURE

BACKGROUND OF THE INVENTION

The present invention relates generally to the field of preformed, light-weight concrete panels for forming walls, and additionally roofs, of buildings. More specifically, the present invention relates to a prefabricated panel composed of a concrete mixture containing polystyrene beads as an additive, with a specialized system of hardware for joining adjacent panels in a secure and stable manner to form an assembly of such panels to define a structure.

Concrete blocks and other prior art wall designs formed upright and incrementally generally have irregular faces and weak cohesion. The placing of concrete blocks is only as accurate as the skill of the block layer permits. The resulting exposed exterior face of the wall is always uneven to some extent, requiring a substantial covering of stucco or other type of finish. More important is that the mortar used to join the concrete blocks is below the strength of properly hardened concrete and forms a relatively weak bond with the blocks. Hurricanes and other natural disasters can sometimes shatter such walls. Finally, the insulating properties of such walls are at most inadequate.

Attempts have been made to solve these problems with a preformed wall. The panel of Walston, U.S. Pat. No. 4,512,126, issued on Apr. 23, 1985, for example, is formed of two layers of polystyrene fitted into a ribbed concrete shell in a multiple step, multiple pour process. Anchor hooks must be embedded in the floor slab when it is poured. Problems with Walston include time-consuming and expensive forming methods and awkwardness and complexity in anchoring procedures.

There have long been prefabricated wall panels for rapid construction of buildings. None teach panels combining high strength, maximum insulating properties, single pour formation, and solid, easy to use anchoring means.

Additional examples of prior panels include Lewis, U.S. Pat. No. 4,494,353, issued on Jan. 22, 1985. Lewis teaches a rigid, rectangular insulating member which fits within opposing vertical hat channels and a bottom channel. The bottom channel is welded to a bottom plate which is secured by anchor bolts to a concrete foundation. Panel connector strips are welded to the hat channels and reinforcing rods extend through holes in the connector strips. Gunite is then sprayed over this structure to form the finished panel. Numerous and complicated metal parts make Lewis expensive. Also, two separate layers of concrete are required, adding pouring and curing time and expense.

Kinard, U.S. Pat. No. 4,532,745, issued on Aug. 6, 1985, discloses a wall formed of foam blocks and channels. The blocks, which have periodic vertical bores, are placed edge to edge. Then a channel with periodic holes is placed along the common top edge of the blocks so that the holes align with the vertical bores. Concrete is poured through the holes into the vertical bores, filling the bores and the channel, and hardens to form a solid skeletal structure. Kinard does not provide a strong external surface suitable for an outside wall.

Dunker, U.S. Pat. No. 4,624,089, issued on Nov. 25, 1986 is an anchor in the form of a plate having holes through which reinforcing rods extend, for holding reinforced sandwich panels together. An end of the anchor also wraps around a perpendicular mesh rod. Concrete is poured to form a carrier panel such that the end of several such anchors protrude therefrom. Then a layer of insulating material is fitted against the panel so that the protruding ends of the anchors punch through the insulating layer. Then rods for the mesh are fitted through holes in the anchor protruding ends and another concrete layer is poured around the mesh and the anchor ends. Only the outside wall of most buildings need to be this strong, so that Dunker is wasteful of materials and needlessly expensive.

Marks, U.S. Pat. No. 4,974,381, issued on Dec. 4, 1990, describes another anchor member for joining the outer slab of a sandwich panel. A metal slat has a hole in each end for receiving a reinforcing rod of each slab, and the slat extends through the middle insulating layer. This anchor is not intended to anchor the panel to a foundation, but is instead part of the internal panel structure. Marks, like Dunker, is another wasteful sandwich arrangement.

Porter, U.S. Pat. No. 4,947,600, issued on Aug. 14, 1990, teaches an interface for mounting a brick wall covering on an existing concrete wall or slab. One side of an angled member is attached to slab to form a shelf, additionally secured by a bracket. Studs extend through and join a foam layer to the slab. Mesh is placed over the foam layer and brick is laid on the shelf in front of the foam. Porter does not teach an effective, economical approach to constructing a new, insulated wall.

Huettemann, U.S. Pat. No. 4,841,702, issued on Jun. 27, 1989, discloses a three-layer panel. The middle panel is an insulating slab such as polystyrene foam. A sheet of particle board is joined to one side and grooves are cut into the other side of the foam slab. Concrete is poured over the grooved side so that the concrete fills the grooves and creates structural ribs. Pouring continues until a layer of concrete is formed on top of the foam slab. Reinforcing rods may be placed in the grooves to strengthen the ribs. No efficient anchoring or lateral connection means are provided.

Zimmerman, U.S. Pat. No. 4,751,803, issued on Jun. 21, 1988, describes a multi-layer insulating panel having preformed concrete ribs. The ribs, referred to as studs, have metal connecting members protruding from one edge. The ribs are placed in parallel relationship in a jig with the connecting members protruding upwards. Additional ribs are formed to create a border around the inside of the jig. A layer of insulating material is placed on top of the ribs and the protruding members pierce through the insulation material. Wire mesh is laid over the insulating material and concrete is poured on top of the mesh. The concrete hardens around the connecting members but does not form a true unitary structure.

Sanger, U.S. Pat. No 5,313,753, issued on May 24, 1994, describes a panel consisting of a layer of concrete with a certain thickness, to which is appended a board of polystyrene foam. A steel stud is inserted vertically in the foam board every 16 in. The concept involved in that invention provides for a sturdy panel with high insulation. Conversely, the use of regular concrete versus the special insulated concrete mix used in the present invention makes for a substantially heavier panel which does not have the flexibility and versatility of the panel obtained with the present invention and requires a more labor intensive process.

It is thus an object of the present invention to provide a prefabricated panel having a simple design which is inexpensive to construct.

It is another object of the present invention to provide a prefabricated panel which has an exterior face of high strength and has superior insulating properties.

It is still another object of the present invention to provide such a prefabricated panel that is simple to pour and permits rapid fabrication.

It is also an object of the present invention to provide such a prefabricated panel which has easy anchoring and interlocking means for rapid and strong assembly.

It is finally an object of the present invention to construct such panels of a special insulated concrete mix which, while it retains the structural qualities demanded by engineering design, additionally provides high insulation properties in and of itself, and lends itself to performance not otherwise available with regular concrete.

SUMMARY OF THE INVENTION

Prefabricated panels are provided for forming walls and roofs of buildings, and each includes a concrete planar portion having a first face and a second face, and optionally at least one sheet of insulating material fitted adjacent to the first face. The concrete planar surface is reinforced with a grid of rods spaced at appropriate intervals in accordance with structural engineering specifications. U-shaped anchors are mounted along the edges of the panels, the anchors having aligned rod-receiving apertures in each extending leg portion and a fastener-receiving aperture in the central bridging portion. The leg portions are positioned within the body of the panel with the central bridging portion exposed on or adjacent to the outer edge of the panel, which may be flat or keyed for better alignment portion, with at least one side of the anchor exposed on the face of the panel for access to tighten the fastener members. The fastener members for joining adjacent panels are two part mechanical fasteners such as a bolt and nut arrangement with either the bolt or the nut having an eyelet or looped end. Reinforcing rods which extend into the concrete body of the panel are inserted through the U-shaped anchors such that the anchors cannot be pulled from the panel. In an adjacent panel, a rod is inserted through the eyelet of the fastener member so that the fastener is likewise secured by the reinforcing rod. With two panels set in place edge-to-edge, the non-secured component of the fastener member is placed through the exposed anchor and joined to the secured component to connect the two adjacent panels.

This mechanism for joining adjacent panels allows the panels to be constructed using a light-weight concrete mixture, since the joining stresses are placed on the reinforcing rods securing the fastener members and the U-shaped anchors. A preferred mixture is composed of cement, sand, polystyrene beads, polyester fibers, plasticizer and water, which when cured provides for a relatively strong and durable panel which is significantly lighter than standard panels.

DETAILED DESCRIPTION OF THE INVENTION

With reference to the drawings, a detailed description of the best mode and the preferred embodiment of the present invention is herein disclosed. However, it should be understood that the disclosed embodiment is merely an example of the invention, which may be embodied in various forms. Therefore, specific structural and functional details disclosed herein should not be interpreted as limiting, but solely as a basis for the claims and as a representative basis for teaching someone skilled in the art to variously employ the present invention in virtually any appropriately detailed structure.

Figure 1:
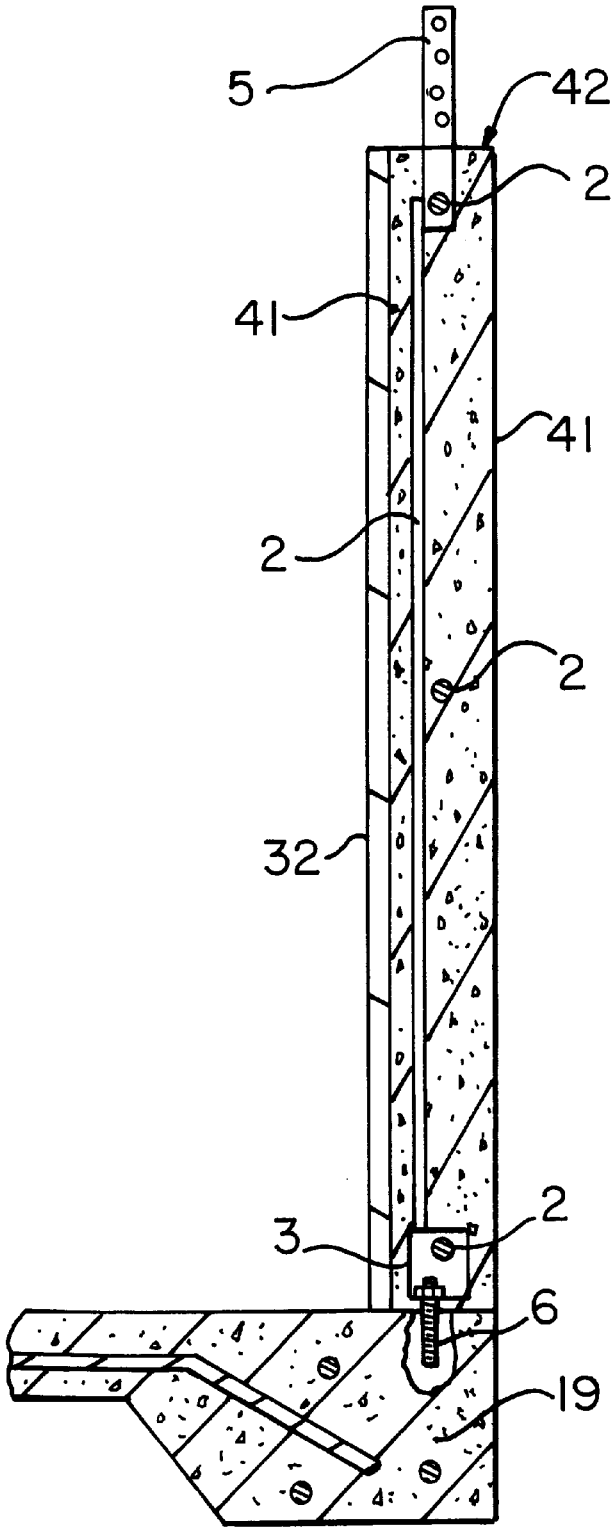
FIG. 1 is a description of the wall attachment to the foundation, as well as of the vertical reinforcing steel rod running from the bottom to the top of the wall, and the roof truss strap embedded at the top of the wall.

In general, the invention comprises a prefabricated, generally rectangular, concrete panel 1 and an assembly of such panels 1 which form the walls or roof of a structure 23, the panels 1 having generally co-planar faces 41 and edges 42 which may in themselves form the exterior or interior surface of the completed structure 23, but which will usually have additional insulating panels 32, stucco or the like applied to their surfaces for aesthetic, insulative or other purposes. As shown in FIG. 1, a wall panel 1 will be erected vertically on a reinforced concrete foundation 19. Threaded anchor rods 6 are embedded within the foundation 19 and bonded with epoxy in known manner, the threaded rod ends extending upward from the slab surface. U-shaped anchor members 3 embedded within the panel 1, in a manner described in more detail below, receive the threaded anchor rods 6 and provide access for a nut to be tightened down onto the rod 6. Roof truss straps 5 extend from the upper edge 42.

Figure 9:
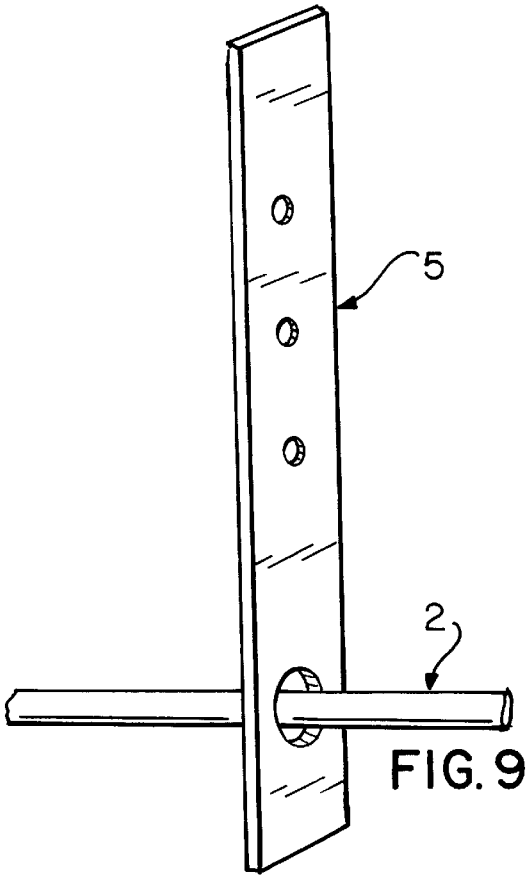
FIG. 9 shows the detail of a roof truss strap at the bottom of which is a hole permitting the insertion of a reinforcing steel rod.
Figure 10:
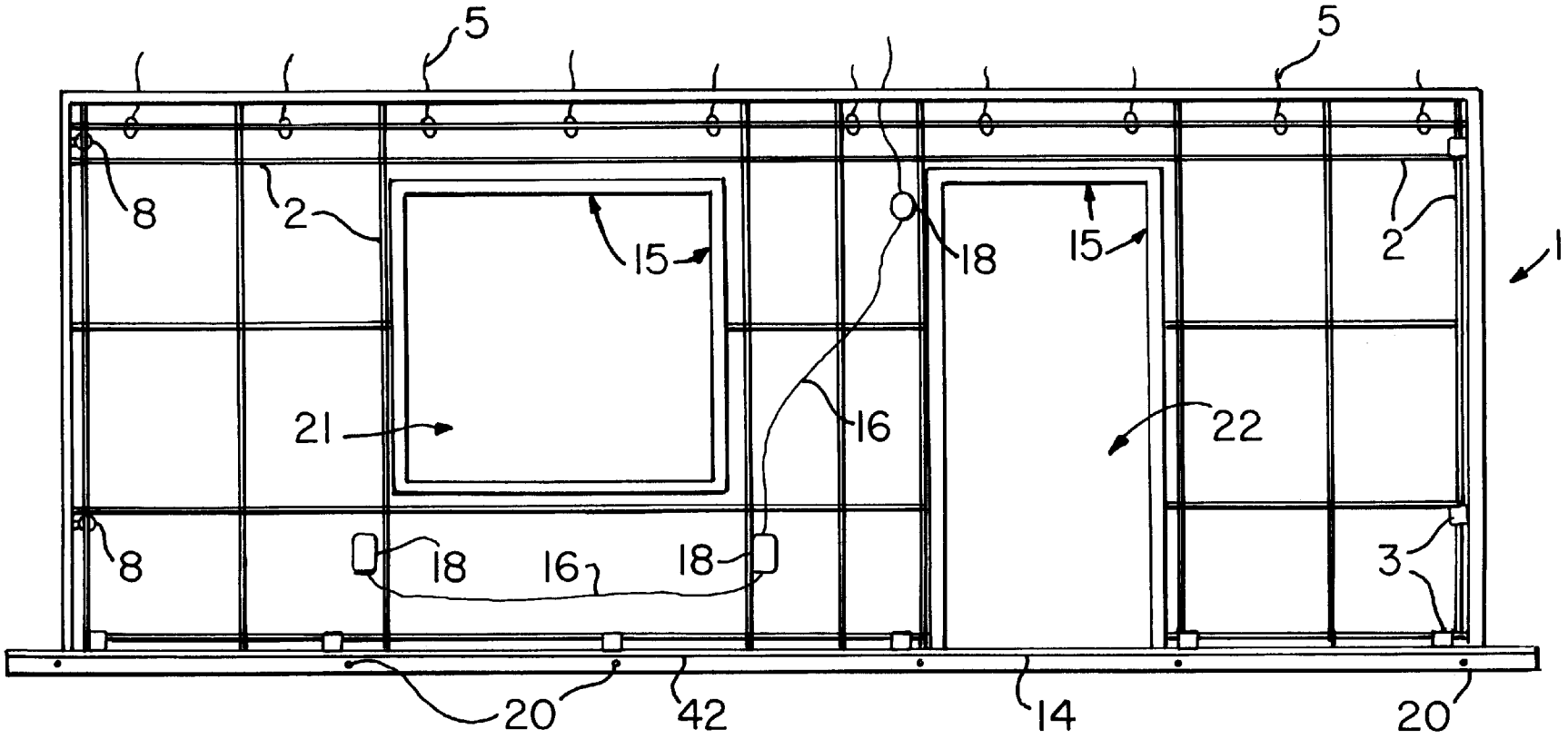
FIG. 10 depicts the initial set up for a prefabricated wall panel laying on the slab floor of the manufacturing plant, ready for insulated concrete pour, showing the framing forms, the grid of reinforcing steel rods and the anchors for the attachment of the various elements to one another and to other parts of the structure, as may be needed.

As seen in FIG. 10, the panels 1 are constructed by providing a framing form 14 of desired size on a planar backing surface, typically a smooth concrete floor. The form 14 may be composed of angle iron pieces secured to the floor by floor bolts 20. A plural number of reinforcing rods 2 are positioned within the form 14, preferably parallel to the sides of the form 14, to provide structural strength to the final panel 1. Channel iron members 15 may be used to define door openings 22 and window openings 21. Likewise, roof truss straps 5, electrical conduits 16 and electrical receptacle and switch boxes 18 are properly laid out within the form 14. A reinforcing rod 2 is preferably passed through the roof truss straps 5, as shown in FIG. 9.

Figure 7:
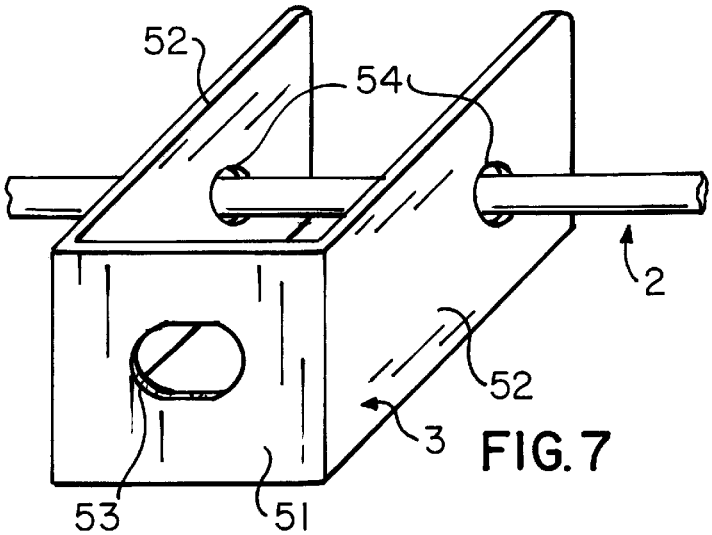
FIG. 7 shows the details of an anchor in which is inserted a reinforcing steel rod.
Figure 8:
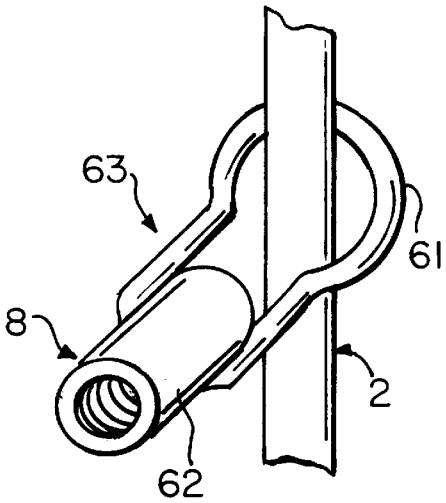
FIG. 8 shows the detail of a ferrule nut in the loop of which a reinforcing steel rod is inserted.

In order to provide a secure and easy means to join panels 1 of the invention to each other, U-shaped anchor members 3 are positioned on the edges of the form 14. The U-shaped anchors 3, as seen in FIG. 7, comprise a central bridging portion 51 joining two leg portions 52, and are preferably constructed of a strong, rigid metal such as galvanized steel. A fastener-receiving aperture 53 is provided in the central bridging portion 51 and a pair of aligned rod-receiving apertures 54 are provided in the leg portions 52. The U-shaped anchors 3 are placed within the form 14 such that the central bridging portion 51 abuts the form 14, so that the central bridging portion 51 will be disposed on the edge 42 of the completed panel 1 when the concrete is poured and cured. A reinforcing rod 2 is passed through the rod-receiving apertures 54 in the leg portions 52 of the U-shaped anchors 3. As shown in FIG. 10, anchors 3 are positioned along the side of the form 14 which defines the edge 42 which will abut the foundation 19 when the panel 1 is used in construction. Anchors 3 are also positioned along one lateral side of the form 14. At locations on the opposing lateral side of the form 14 corresponding to the lateral U-shaped anchor members 3, one part of the mechanical fastener means 60 is placed into the form 14 to become the secured member 63, which as shown comprises a ferule eye nut 8 having a looped end or eyelet 61 joined to an internally threaded sleeve 62, as best seen in FIG. 8. A reinforcing rod 2 is passed through the eyelets 61. With all the components in proper position within the form 14, concrete is poured and allowed to cure, such that the components are all permanently embedded within the panel 1. The secured member 63 of the mechanical fastener means 60 becomes embedded in the hardened concrete, while the interiors of the U-shaped anchors 3 are covered during the pouring operation so they are not filled in with concrete, leaving an open side to access the interior of the anchors 3, as seen in FIG. 2.

Figure 2:
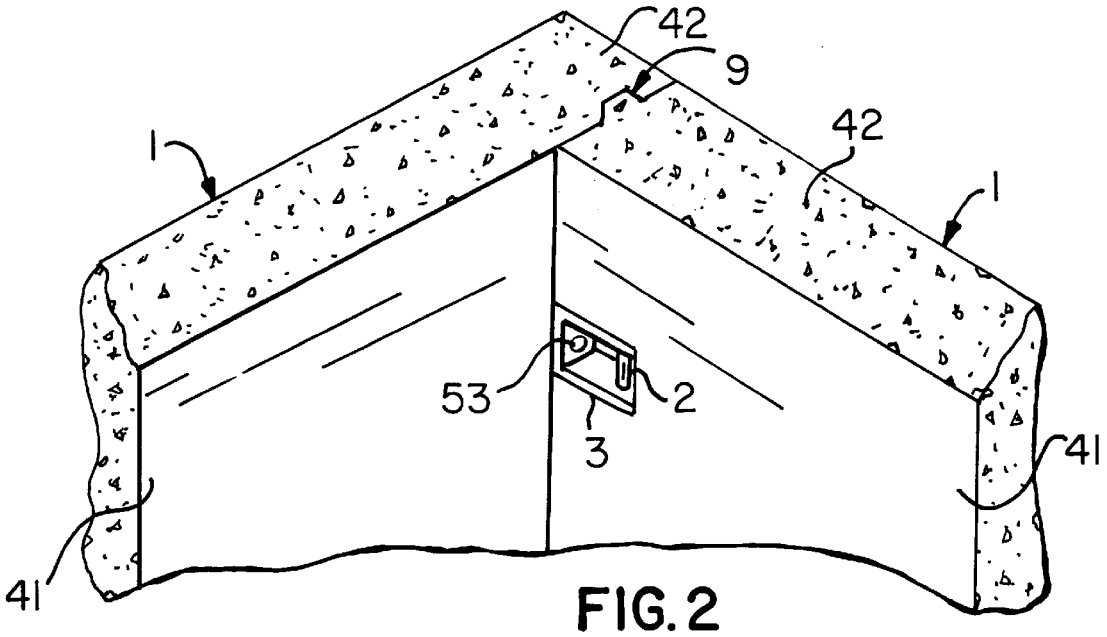
FIG. 2 shows the mode of attachment between corner walls, based on a tongue and groove system, including the reinforcing steel rod penetrating the U-shaped anchor member.
Figure 3:
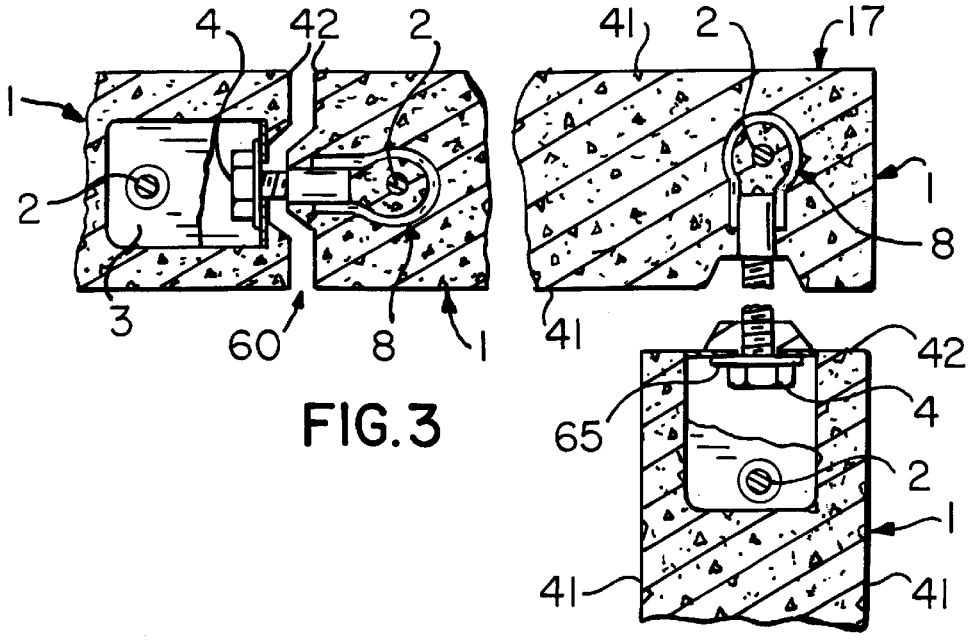
FIG. 3 shows the detail of the U-shaped anchors and of the bolt and ferrule loop nut for the connection of two either lateral or corner walls.
Figure 4:
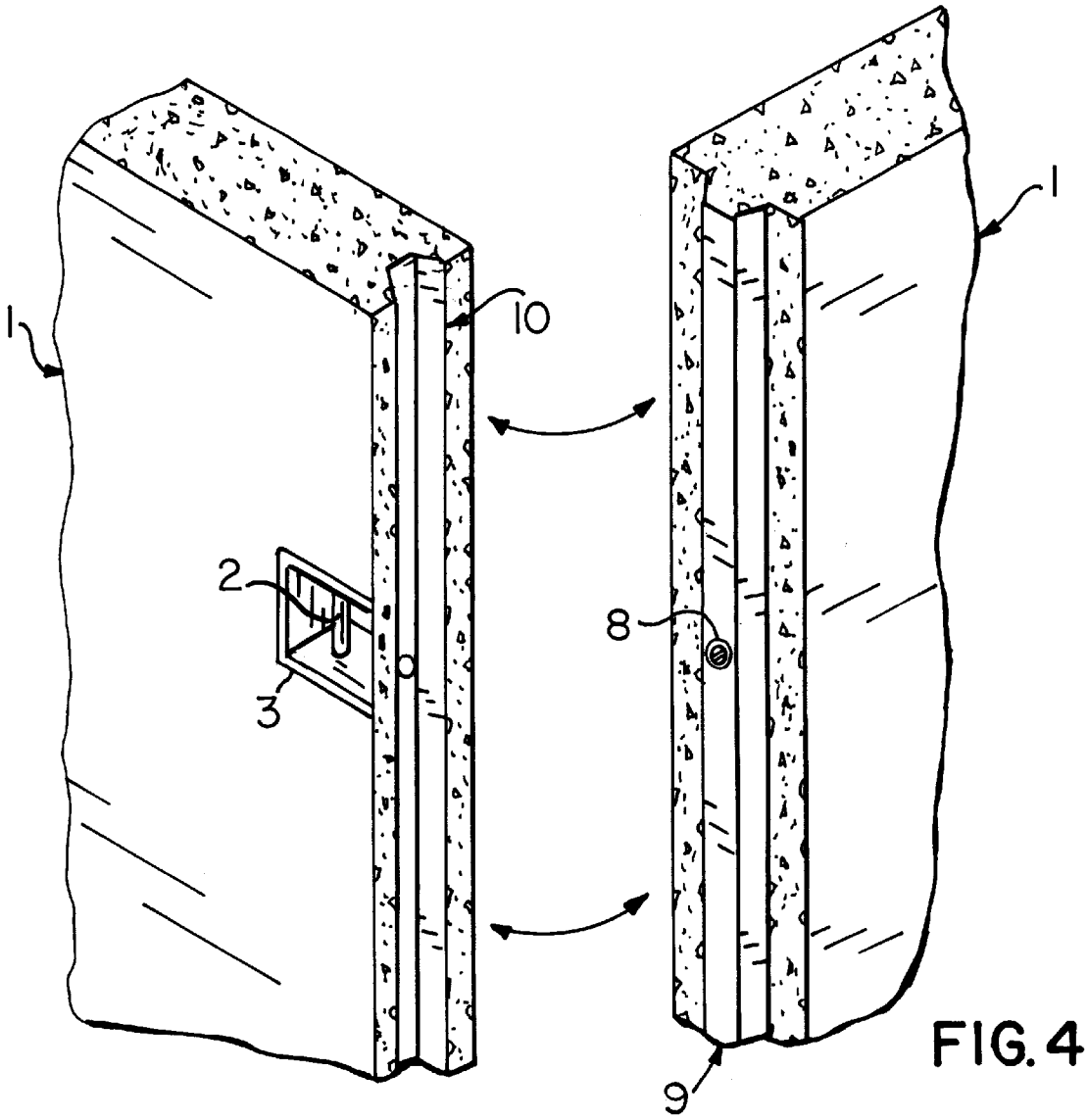
FIG. 4 shows the tongue and groove system which permits the attachment of two lateral walls, with the U-shaped anchor through which a reinforcing steel rod passes on the one wall and the connecting ferrule loop nut on the other wall.
Figure 5:
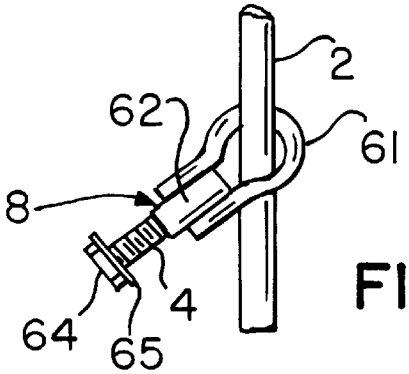
FIG. 5 shows a detail of the ferrule nut through which passes a reinforcing steel rod.
Figure 6:
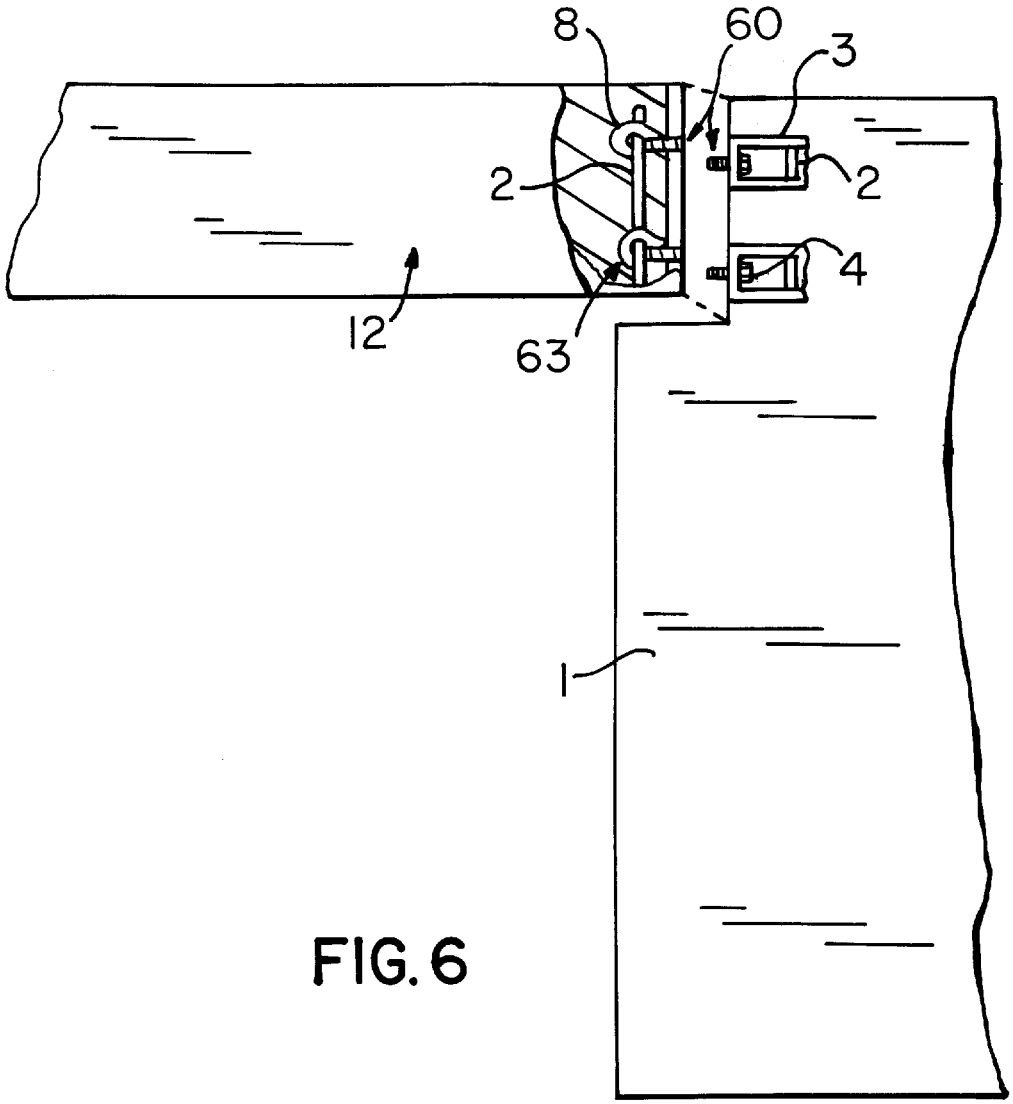
FIG. 6 represents the connection of a vertical and a horizontal wall for garage, glass sliding door or other large opening, including the attachment of these walls at the top through two U-shaped anchors containing bolts and, in the horizontal header, two ferrule nuts in the loops of which a reinforcing steel rod is located.

The panels 1 may have flat edges 42 as shown in FIG. 6 or keyed edges 42 as shown in FIGS. 2, 3 and 4. The keyed edges 42 comprise an outwardly extending key 9 and corresponding inwardly extending recess 10 which mate to form a tight junction. With adjoining panels 1 properly aligned, the central bridging portion 51 of the U-shaped anchors 3 will abut the exposed end of the secured ferrule eye nut 8 such that the fastener-receiving aperture 53 aligns with the opening in the sleeve 62. The unsecured member 64 of the mechanical fastener means 60, shown herein as an externally threaded bolt 4, is passed into the interior of anchor 3, inserted through the fastener-receiving aperture 53 and threaded into the sleeve 62 of the secured member 63. Preferably metal washers 65 are placed onto the bolt 4 prior to insertion. For construction of a corner, the secured member 63 is embedded in the concrete body of the panel 1 such that it is exposed through one of the faces 41, as shown in FIG. 3.

With this type of assembly, the stresses arising from securely tightening the mechanical fastener means 60 are borne by the reinforcing rods 2 and not by the concrete body of the panel 1 or the U-shaped anchors 3 alone. This insures that the mechanical fastener means 60 and the U-shaped anchor members 3 will not be pulled from the concrete body of the panel 1. The forces between the panels 1 are distributed from one reinforcing bar 2 in one panel 1, through the secured member 63, herein the ferrule eye nut 8, through the unsecured member 64, herein the bolt 4, through the washer 65, through the U-shaped anchor 3 and to the second reinforcing bar 2 in the adjoining panel 1. Short of failure of the mechanical fastener means 60, the panels 1 will not separate under stress unless the reinforcing rods 2 are pulled from the concrete body.

Figure 11:
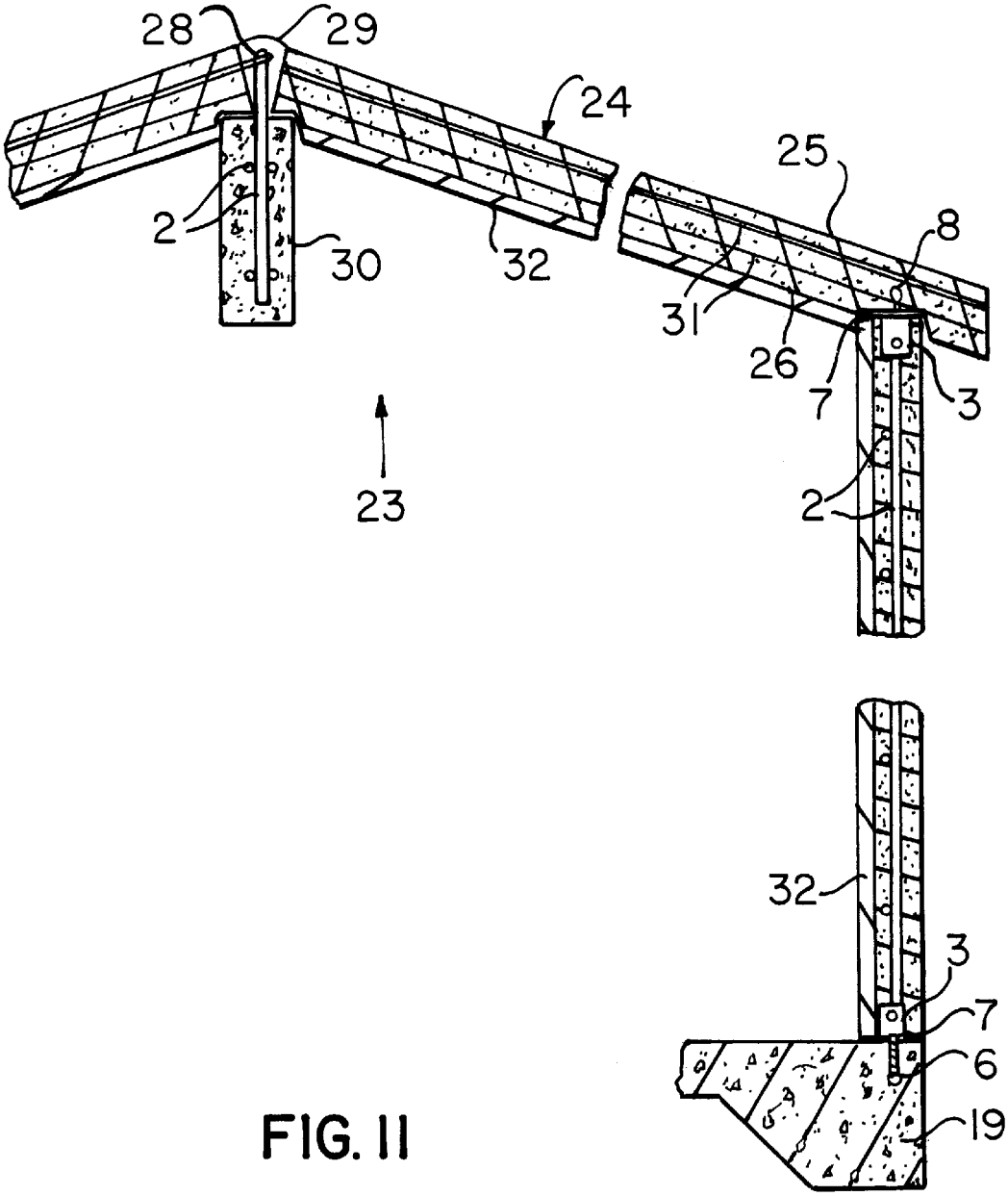
FIG. 11 shows the cross sectional side view of a building or structure constructed with panels utilized for roofs and walls and showing a pitched roof.
Figure 12:
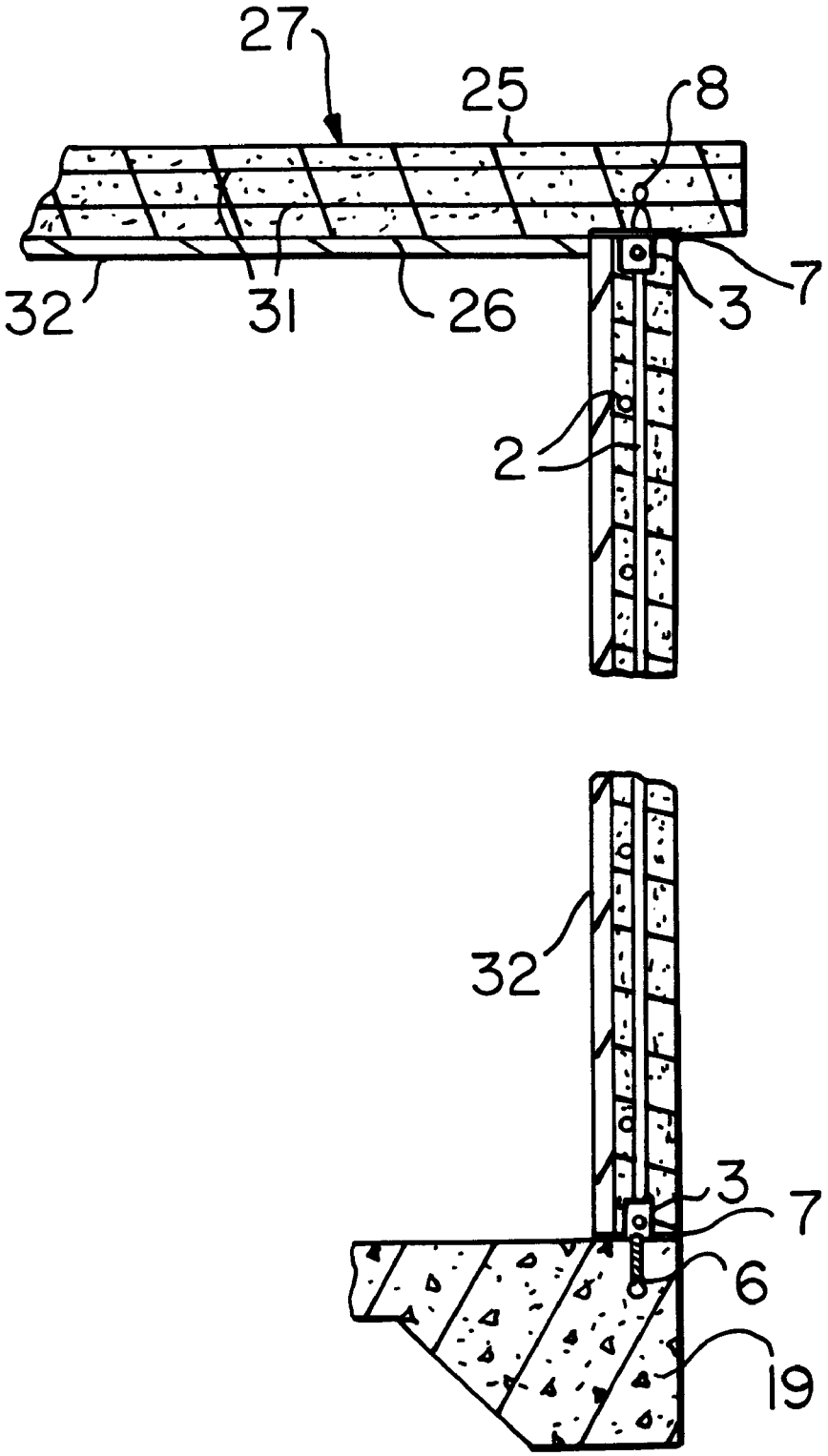
FIG. 12 shows the cross sectional side view of a building or structure constructed with panels utilized for roofs and walls and showing a flat roof.

This joining system can be utilized to join other preformed structures besides wall panels 1, as shown in FIGS. 6, 11 and 12. FIG. 6 shows a concrete header 12 being joined to a wall panel 1, where a pair of mechanical fastener means 60 of the type previously described are used. Again, a reinforcing rod 2 is placed through the secured members 63 and a separate reinforcing rod 2 is placed through the anchors 3. FIG. 11 shows a structure 23 with a pitched roof 24 mounted onto a wall panel 1, the roof panel 24 having a front wall 25 and an interior wall 26, the panel 24 having wire mesh reinforcement 31 in addition to the reinforcing rods 2. The apex of the roof 24 is supported by an interior structural beam member 30, and the apex edges of the panels 24 are provided with extended reinforcing rods 28 which are tied. The gap is then filled with grout 29, and adhesive caulk 7 is preferably used between the wall panel 1 and the roof panel 24. FIG. 12 is a similar construction but with a flat roof 27.

The panels 1 may be formed of any suitable material, but the assembly is ideally suited for use with panels 1 made of light-weight concrete. A particularly suitable mixture comprises approximately 4.5 bags of cement, approximately 9 bags of sand, approximately 13.5 bags of polystyrene beads, approximately 2 pounds of polyester fibers and preferably approximately 38 ounces of a plasticizer per cubic yard of total mixture. This ratio of approximately 1:2:3 cement to sand to polystyrene beads produces a cured panel having about 2000–2100 psi compressive strength with a weight of only about 75–80 pounds per cubic foot, as compared to about 110 pounds per cubic foot for regular concrete panels. The polystyrene beads greatly increases the insulation value, giving the panel a rating of 2.1 R per inch thickness, compared to regular concrete with an R value of 0.2 R per inch thickness. The panels have been tested up to 170 mph on wind load before failure.

Although the present invention has been described, disclosed, illustrated and shown in various terms or certain embodiments or modifications which it has assumed in practice, the scope of this invention is not intended to be, nor should it be deemed to be, limited thereby and such other modifications or embodiments as may be suggested by the teachings herein are particularly reserved, especially as they fall within the breadth and scope of the claims here appended.

I claim:

1. A prefabricated concrete panel for forming walls and roofs of structures, comprising:

a generally planar portion composed primarily of concrete having a pair of faces and a pair of opposing edges for joining said panel to other like panels, and reinforcing rods embedded within said panel;

at least one U-shaped anchor member embedded within said panel, said anchor member comprising a central bridging portion connecting to two leg portions, said central bridging portion disposed adjacent one of said opposing edges of said panel, said central bridging portion having a fastener-receiving aperture and said leg portions each having a rod-receiving aperture, where one of said reinforcing rods passes through each said rod-receiving aperture to secure said anchor member to said panel and where the interior of said anchor member is accessible from at least one of said faces;

mechanical fastener means for securely connecting said panel to other like panels, said mechanical fastener means comprising a non-secured member which is connectable to a secured member, where said non-secured member is inserted through said fastener-receiving aperture of said at least one anchor member, and where said secured member is embedded within said panel adjacent the other of said opposing edges of said panel, where said secured member is secured within said panel by another of said reinforcing rods.

2. The panel of claim 1, where said secured member comprises an eyelet and said another of said reinforcing rods is inserted through said eyelet.

3. The panel of claim 2, where said secured member further comprises an internally threaded sleeve, and where said non-secured member comprises an externally threaded bolt.

4. The panel of claim 1, where said pair of opposing edges are flat.

5. The panel of claim 1, where one of said pair of opposing edges comprises an outwardly extending key and the other of said pair of opposing edges comprises a recess corresponding in configuration to said key.

6. The panel of claim 1, where said concrete is composed of a mixture comprising approximately one part by volume cement, two parts by volume sand, and three parts by volume polystyrene beads as light-weight aggregate filler.

7. The panel of claim 6, where said mixture further comprises polyester fibers and a plasticizer.

8. The combination of a first prefabricated concrete building panel and a second prefabricated concrete building panel connected to form a structural component of a building;

said first panel comprising a generally planar portion composed primarily of concrete having a pair of faces and at least one edge for mating with said second panel, at least one reinforcing rod embedded within said first panel, and at least one U-shaped anchor member embedded within said first panel, said anchor member comprising a central bridging portion connecting to two leg portions, said central bridging portion disposed adjacent said edge of said first panel, said central bridging portion having a fastener-receiving aperture and said leg portions each having a rod-receiving aperture, where said at least one reinforcing rod passes through each said rod-receiving aperture to secure said anchor member to said panel and where the interior of said anchor member is accessible from at least one of said faces, and a non-secured fastener member inserted through said fastener-receiving aperture of said anchor member;

said second panel comprising a generally planar portion composed primarily of concrete having a pair of faces and at least one edge for mating with said first panel, at least one reinforcing rod embedded within said second panel, and at least one secured fastener member embedded within said panel adjacent said edge, said secured fastener member is secured within said second panel by said reinforcing rod;

where said first panel edge is mated with said second panel edge and said non-secured fastener member is connected to said secured fastener member to join said first panel to said second panel.

9. The combination of claim 8, where said secured member comprises an eyelet and said reinforcing rod is inserted through said eyelet.

10. The combination of claim 9, where said secured member further comprises an internally threaded sleeve, and where said non-secured member comprises an externally threaded bolt.

11. The combination of claim 8, where each of said edges is flat.

12. The combination of claim 8, where said edge of said second panel comprises an outwardly extending key and said edge of said first panel comprises a recess corresponding in configuration to said key.

13. The combination of claim 8, where said concrete is composed of a mixture comprising approximately one part by volume cement, two parts by volume sand, and three parts by volume polystyrene beads as light-weight aggregate filler.

14. The combination of claim 13, where said mixture further comprises polyester fibers and a plasticizer.

* * * * *